US008506245B2

(12) United States Patent
Xiong et al.

(10) Patent No.: US 8,506,245 B2
(45) Date of Patent: Aug. 13, 2013

(54) STEAM TURBINE SHELL

(75) Inventors: Yuexi Xiong, Niskayuna, NY (US); Edward Leo Kudlacik, Glenville, NY (US); Norman Douglas Lathrop, Ballston Lake, NY (US); Christopher Walter Sullivan, Galway, NY (US); David Ernest Welch, Amsterdam, NY (US)

(73) Assignee: General Electric Company, Schenectady, NY (US)

( * ) Notice: Subject to any disclaimer, the term of this patent is extended or adjusted under 35 U.S.C. 154(b) by 546 days.

(21) Appl. No.: 12/832,530

(22) Filed: Jul. 8, 2010

(65) Prior Publication Data

US 2012/0006026 A1 Jan. 12, 2012

(51) Int. Cl.
*F03B 11/02* (2006.01)

(52) U.S. Cl.
USPC ..... 415/214.1; 415/215.1

(58) Field of Classification Search
USPC ..... 415/108, 214.1, 215.1, 219.1, 220, 415/216.1, 221, 222, 223
See application file for complete search history.

(56) References Cited

U.S. PATENT DOCUMENTS 4,451,219 A * 5/1984 Kurherr ..... 418/138

* cited by examiner

*Primary Examiner* — Edward Look
*Assistant Examiner* — Maxime Adjagbe
(74) *Attorney, Agent, or Firm* — Hoffman Warnick LLC; Ernest G. Cusick

(57) ABSTRACT

A steam turbine apparatus is disclosed. In one embodiment, the steam turbine apparatus comprises: an exhaust shell portion including: a first section having a semi-circular cross-section; an exhaust section contiguous with the first section, the exhaust section including an intermediate-pressure exhaust outlet; and a second section having an oblate spherical cross-section including a substantially flattened portion, the second section configured to fluidly connect with the first section, wherein the first section and the second section form a continuous steam flow path.

20 Claims, 5 Drawing Sheets

STEAM TURBINE SHELL

BACKGROUND OF THE INVENTION

The subject matter disclosed herein relates to a cast shell for steam turbine systems. Specifically, the subject matter disclosed herein relates to a high or intermediate-pressure portion of a cast shell for a steam turbine system, the high or intermediate-pressure portion of the shell having a portion including an oblate spherical cross-section.

Steam turbine shells are components that encompass, for example, the high pressure (HP) and/or intermediate pressure (IP) sections of the steam turbine. In practice, steam turbine shells hold the stationary steampath components in close proximity to the rotating steampath components. Nozzle connections included in the structural shell allow for the entry and exit of the working fluid (e.g., steam) from the shell. In addition, several portions of the shell are configured and contoured to provide efficient flow path transitions between the nozzles and steampath components. Traditional steam turbine shells include both inlet (or admission) sections and exhaust (or extraction) sections having a substantially concentric-shaped channel configured to surround a portion of the steampath sections of the turbine. The different sections of the combined turbine shell (e.g., HP, IP, etc.) will have differing volumes and cross-sectional sizes.

BRIEF DESCRIPTION OF THE INVENTION

An exhaust portion of a steam turbine shell system is disclosed. In one embodiment, an steam turbine apparatus includes: an exhaust shell portion including: a first section having a semi-circular cross-section; an exhaust section contiguous with the first section, the exhaust section including an exhaust outlet; and a second section having an oblate spherical cross-section including a substantially unitary bottom portion, the second section configured to fluidly connect with the first section, wherein the first section and the second section form a continuous steam flow path.

A first aspect of the invention includes a steam turbine apparatus comprising: an exhaust shell portion including: a first section having a semi-circular cross-section; an exhaust section contiguous with the first section, the exhaust section including an exhaust outlet; and a second section having an oblate spherical cross-section including a substantially unitary bottom portion, the second section configured to fluidly connect with the first section, wherein the first section and the second section form a continuous steam flow path.

A second aspect of the invention includes a steam turbine system comprising: a rotor; a plurality of blades operably connected to the rotor; and a shell surrounding the rotor and the blades, the shell including: an exhaust shell portion including: a first section having a semi-circular cross-section; an exhaust section contiguous with the first section, the exhaust section including an exhaust outlet; and a second section having an oblate spherical cross-section including a substantially unitary bottom portion, the second section configured to fluidly connect with the first section, wherein the first section and the second section form a continuous steam flow path A third aspect of the invention includes a steam turbine shell portion comprising: a section having an oblate spherical cross-section, the section having a polar radius and a first equatorial radius in an approximate ratio of Z:X, wherein Z=3 and X=4.

BRIEF DESCRIPTION OF THE DRAWINGS

These and other features of this invention will be more readily understood from the following detailed description of the various aspects of the invention taken in conjunction with the accompanying drawings that depict various embodiments of the invention.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a steam turbine shell including an intermediate-pressure section having an oblate spherical cross-section. In one embodiment, the oblate spherical section includes a substantially unitary bottom portion.

Single shell steam turbine castings, where the cast shell includes both the high-pressure and intermediate-pressure sections, may allow for reduced costs in, e.g., manufacturing, shipping and/or construction when compared to separate shell castings. In systems using a single shell casting, the weight of the shell is completely supported by support arms located near axial ends of the shell. The shell's weight places mechanical stress great enough to produce significant deflection of the support bars while the steam turbine is in service. Additionally, a substantial portion of the cost of materials for the steam turbine shell may be dedicated to the IP section. Aspects of the invention provide for a reduction in the weight of the shell (e.g., the shell's IP section). These aspects may reduce the amount of material used in forming the shell, while still allowing the shell to be cast using conventional processes.

Figure 1:
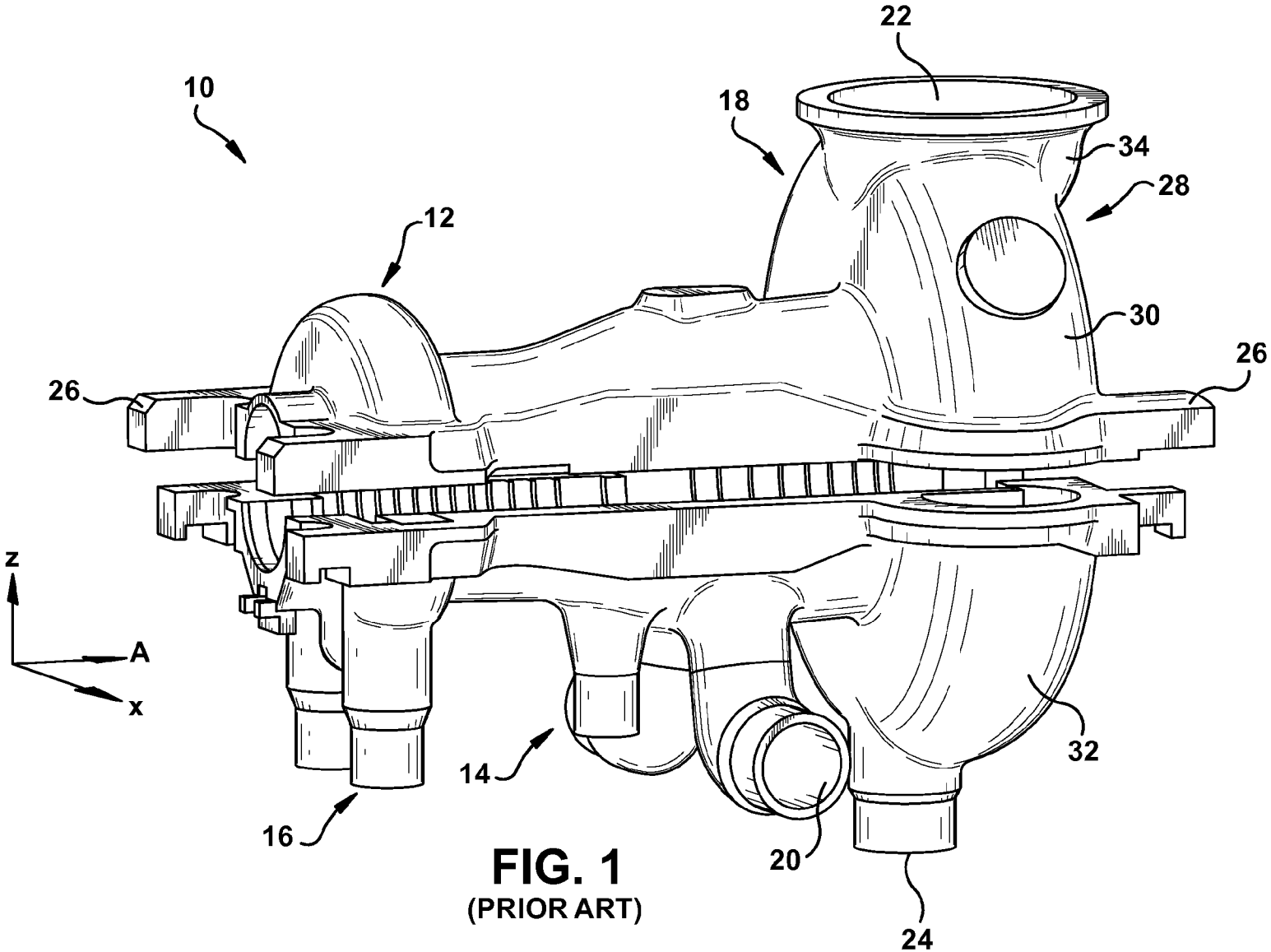
FIG. 1 (PRIOR ART)
FIG. 1 shows a three-dimensional perspective view of a steam turbine shell according to the prior art.

Turning to FIG. 1, a three-dimensional perspective view of a prior art steam turbine shell 10 for, e.g., an opposed flow steam turbine is shown. As shown, steam turbine shell 10 may have a high-pressure (HP) section 12 including an HP inlet 14 and an HP exhaust outlet 16. As is known in the art, HP inlet 14 may be configured to receive high-pressure steam from a steam source (e.g., a heat recovery steam generator, not shown), and guide that steam toward the high pressure section of a steam turbine partially enclosed therein to perform mechanical work by forcing rotation of turbine blades. After performing mechanical work in the high pressure section of the steam turbine, steam may be guided through HP exhaust outlet 16, and provided to, e.g., a heat exchanger. Steam turbine shell 10 may also include an intermediate-pressure (IP) section 18 having an IP inlet 20, an IP exhaust outlet 22, and a nozzle connection (e.g., a low-pressure (LP) admission inlet) 24. A divider (not shown) may be included in steam turbine shell 10 to divide HP section 12 and IP section 18. As is known in the art, IP inlet 20 may be configured to receive intermediate pressure steam from a steam source (e.g., a heat recovery steam generator, not shown), and guide that steam toward the intermediate pressure section of the steam turbine to perform mechanical work by forcing rotation of turbine blades. After performing mechanical work in the intermediate pressure section of the steam turbine, a majority of this steam may be guided through IP exhaust outlet 22, and a second portion of this steam may be guided through nozzle connection (e.g., LP admission inlet) 24, where it may be supplied to, e.g., a LP section of the turbine (not shown).

Steam turbine shell 10 may also include support arms 26, which may be located at axial ends of the steam turbine shell 10. Steam turbine shell 10 may also include an intermediate-pressure shell portion (or simply, portion) 28 having an upper section 30 and a lower section 32. Steam turbine shell 10 may also include an exhaust section 34 contiguous with (e.g., cast along with) upper section 30. As is known in the art, exhaust section 34 may include one or more nozzles or flanges cast integral with steam turbine shell 10 and oriented substantially transverse to an axis (direction "A" of the key in lower-left corner of FIG. 1, axis omitted for clarity) of a steam turbine at least partially contained within steam turbine shell 10). Upper section 30 and lower section 32 may be substantially symmetrical about an axial plane, running parallel to the axis (A). That is, upper section 30 and lower section 32 may respectively have substantially semi-circular, symmetrical cross-sections (excluding exhaust section 34 and LP admission inlet 24, respectively), and may be configured to join at the axial plane (or, equatorial surface) running therebetween. This axial plane, or equatorial surface (E), may also be referred to herein as a "horizontal joint surface." While the equatorial surface (E) is not visible from the three-dimensional perspective view of FIG. 1, it is shown in the end views of the IP shell portion of FIGS. 2-3, running between upper section 30 and lower section 32. It is understood that the equatorial surface (E) (or, axial plane) is used as a reference plane to aid in illustrating aspects of the invention. As is known in the art, upper section 30 and lower section 32 may be formed via casting, and their symmetrical cross-sections may simplify the casting process.

Figure 2:
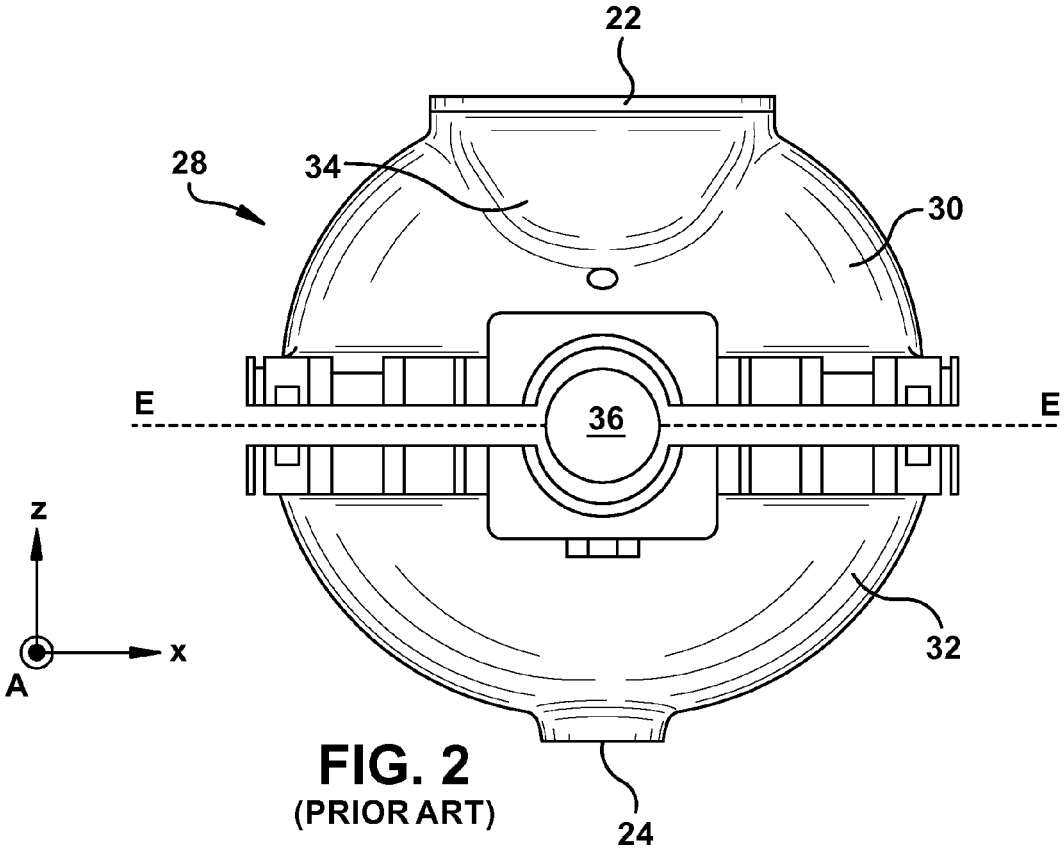
FIG. 2 (PRIOR ART)
FIG. 2 shows an end view of an intermediate pressure section of the prior art steam turbine shell of FIG. 1.
Figure 3:
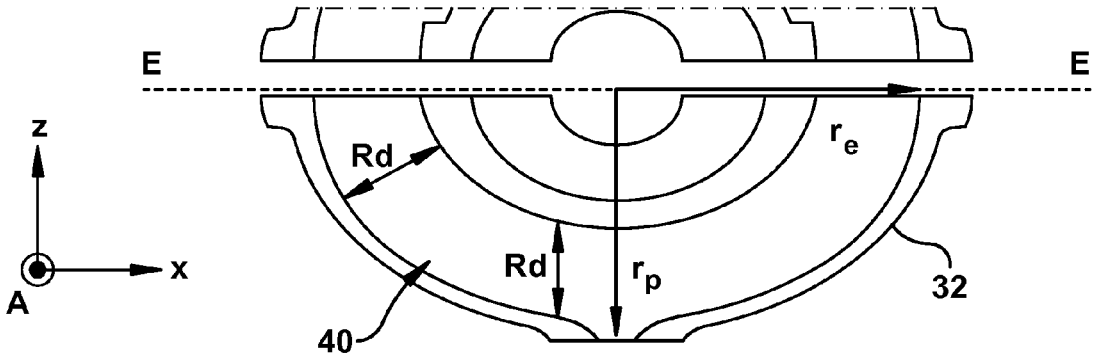
FIG. 3 (PRIOR ART)
FIG. 3 shows a partial cut-away of an end view of an intermediate pressure section of the prior art steam turbine shell of FIG. 1.

Turning to FIG. 2, the prior art IP shell portion 28 of FIG. 1 is shown in a schematic end-view illustration. As shown, IP shell portion 28 may at least partially surround a steam turbine rotor (or simply, rotor) 36, which may have a plurality of blades or "buckets" attached thereto (blades omitted for clarity). Rotor 36 and its rotor blades may be surrounded by a diaphragm assembly (omitted for clarity), which may also be at least partially surrounded by IP shell portion 28. Further, upper section 30 and lower section 32 may be substantially symmetrical about the equatorial plane (E), excluding exhaust section 34, and LP admission inlet 24. That is, a polar radius (rp) and a first equatorial radius (re) of IP shell portion 28 may have a substantially equal value (FIG. 3). In other words, the distance from a central point of rotor 36 to an outer surface of lower section 32 along the equatorial (or axial) plane (E) is substantially the same as the distance from the central axial point of rotor 36 to an outer surface of lower section 32 along an axis (e.g., z-axis) perpendicular to the equatorial plane (E). As shown in FIG. 3, this relationship between dimensions of IP shell portion 28 may further be described as such: lower section 32 includes a first equatorial radius (re) that is substantially equal to a polar radius (rp), meaning lower section 32 forms an approximately semi-circular shape with a horizontal joint surface abutting the equatorial plane (E).

Lower section 32 is configured to fluidly connect with upper section 30, wherein upper section 30 and lower section 32 form a continuous steam flow channel, or path 40 (shown in FIG. 3). Continuous steam flow path 40 may have a substantially uniform radial depth (Rd). This radial depth may be measured as a radial distance from an innermost point in continuous flow path 40 to an outermost point in continuous flow path 40 (e.g., an inner wall of lower section 32) along a given radial line. As shown, radial depth (Rd) at or near an uppermost portion of lower section 32 is substantially equal to the radial depth (Rd) at or near a lowermost portion of lower section 32. That is, the substantially semi-circular lower section 32 of the prior art includes a steam flow path 40 having a substantially uniform radial depth (Rd).

As described herein, IP shell portion 28 may contribute a significant proportion of the weight of steam turbine shell 10. Additionally, IP shell portion 28 may require a significant amount of material to manufacture (e.g., using a casting process). Additionally, many portions of steam turbine shell 10 are subject to internal steam pressure and temperatures (thermal loads). The mechanical and thermal loads on many portions steam turbine shell 10 may cause it to deform (e.g., as a support beam deforms under load), which may cause design problems relating to clearances internal to steam turbine shell 10 (e.g., distances between rotating components of the steam turbine and the inner walls of steam turbine shell 10).

Figure 4:
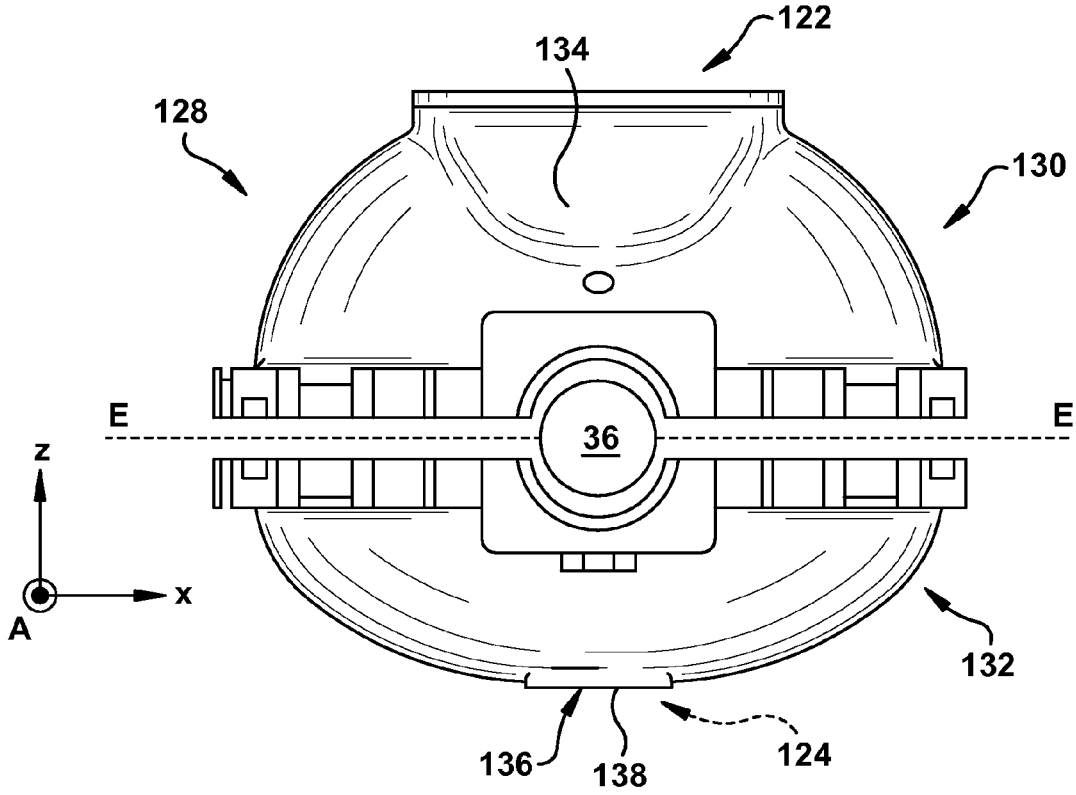
FIG. 4 shows an end view of an intermediate pressure steam turbine shell section according to an embodiment.

Turning to FIG. 4, an exhaust shell portion (e.g., an IP exhaust shell portion) 128 is shown according to an embodiment. In contrast to the IP shell portion 28 shown and described with reference to FIGS. 1-3, in one embodiment, exhaust shell portion (IP exhaust shell portion) 128 includes a section (or, "second section", e.g., a lower section) 132 having an oblate spherical cross-section including a substantially unitary bottom portion 136. That is, lower section 132 and an upper section 134 (described further herein) are asymmetrical about an equatorial plane (E). Unlike the substantially semi-circular lower section 32 shown and described with reference to FIGS. 1-3, section 132 has an oblate spherical cross-section. As used herein, the term, "oblate spherical" describes the cross-section of lower section 132 according to embodiments. This oblate spherical cross-section may be defined in part by the relationship between a first equatorial radius (rea) and a polar radius (rp) of the geometric cross-section. For example, in one embodiment the first equatorial radius (re) and the polar radius (rp) may have a ratio of approximately X:Z, where X (4) and Z=(3). In other words, the distance from a central axial point of rotor 36 to an outer surface of section 132 along the equatorial (or axial) plane (E) is greater than the distance from the central point of rotor 36 to an the outer surface of section 132 along an axis (e.g., z-axis) perpendicular to the equatorial plane (E). It is noted that while the term "oblate spherical" may be used to refer to the cross-section of section 132 along the z-x plane, this section 132 may have a three-dimensional shape substantially similar to half of a scalene ellipsoid. A scalene ellipsoid is a quadratic structure having two distinct equatorial radii, (rex), along the x-axis, and (rea), along the axial axis, and a polar radius (rp) distinct from both the equatorial radii. In one embodiment, the first equatorial radius (rex), second equatorial radius (rea), and polar radius (rp) may have a ratio of approximately X:Y:Z, where X=(4), Y=(3.5), and Z=(3). In other words, the radius of section 132 becomes progressively smaller as measured going away from the equatorial plane (E) along an outermost surface of section 132.

In one embodiment, section 132 may include a substantially unitary bottom portion 136. Substantially unitary bottom portion 136 may be devoid of a nozzle connection (e.g., an LP admission inlet such as LP admission inlet 24 of FIG. 2, or an inlet connection) and may include a substantially flattened portion 138. Substantially flattened portion 138 may span a distance at least as great as the diameter of rotor 36, and may be substantially parallel to equatorial surface (E). Further, substantially flattened portion 138 may be a shorter distance from the central axial point of rotor 36 than a bottom portion of an exhaust section 134 contiguous with a first section 130 (where exhaust section 134 is tapered at an exhaust outlet 122 away from first section 130).

In one embodiment, first section 130 may provide for a low-pressure (LP) admission inlet by diverting a portion of the exhaust steam provided to an intermediate-pressure exhaust outlet 122 to a low-pressure section of a steam turbine. In an alternate embodiment, section 132 may include a low-pressure (LP) admission inlet 124 (indicated in phantom) configured to emit approximately zero to approximately five percent of an amount of exhaust steam emitted from intermediate-pressure exhaust outlet 122. In another embodiment, multiple nozzle connections, or ports (e.g., outlets or inlet ports) may be located on section (or, second section) 132 at various locations. In another embodiment, multiple ports (e.g., outlets or inlet ports) may be located on first section 130 at various locations.

Figure 5:
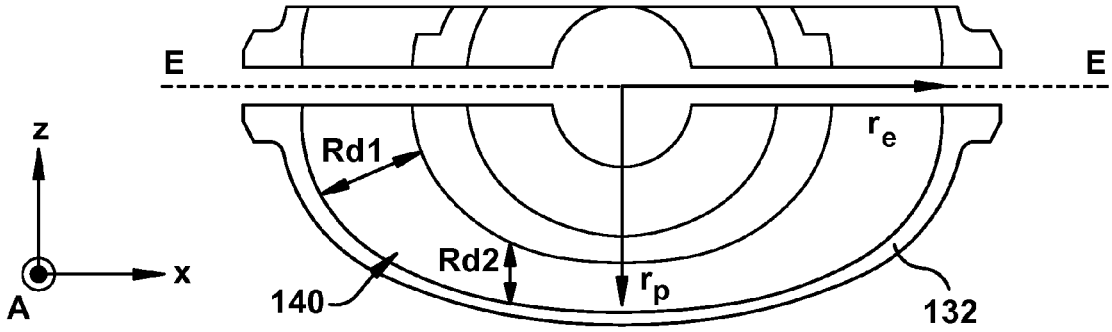
FIG. 5 shows a partial cut-away of an end view of an intermediate pressure section of the steam turbine shell of FIG. 4.

In any case, second section 132 is configured to fluidly connect with first section 130, wherein first section 130 and second section 132 form a continuous steam flow channel, or path 140. That is, second section 132 and first section 130 may be joined along the equatorial surface (or, horizontal joint surface) (E) and substantially seal the steam turbine intermediate pressure section from an external environment. It is understood that lower section 132 and upper section 130 may be bound at horizontal joint surface (E) via, e.g., bolting, welding, and/or other sealing and binding methods known in the art. In accordance with embodiments of the invention, as shown in FIG. 5, the steam channel 140 may have a greater radial depth (Rd1) at or near an uppermost portion of the lower shell section than at a lowermost portion of the lower shell section (having a distinct, smaller radial depth (Rd2)). That is, first section 130 and second section 132 may have substantially similar radial depths (Rd1) near the horizontal joint surface (E) such that when joined, first section 130 and second section 132 form a continuous flow path. However, as described herein, radial depth Rd2 will be distinct from, and smaller than, Rd1.

It is understood that the teachings described herein may be applied to sections of a steam turbine shell other than an IP section. For example, an HP section of a steam turbine shell may include a first section having a semi-circular cross-section; and a second section having an oblate spherical cross-section including a substantially flattened portion, the second section configured to fluidly connect with the first section, wherein the first section and the second section form a continuous steam flow path. In this case, as is similarly described with reference to FIGS. 4-5 regarding an IP shell portion 128, the first portion and the second portion may be asymmetric about the axial plane (or equatorial surface (E)), excluding the one or more inlet or exhaust sections.

It is further understood that in an embodiment, second section 132 (having oblate spherical cross-section) may be located vertically above (in the z-direction) first section 130. That is, the orientation shown and described with reference to FIGS. 4-5 may be "flipped", wherein second section 132 is located substantially vertically above rotor 36, and first section 130 is located substantially below rotor 36. It is further understood that in this embodiment, exhaust section 134 may be formed contiguous with second section 132 (e.g., via casting) and located vertically above first section 130. Other orientations are also possible, e.g., wherein the equatorial plane (E) is not substantially horizontal.

Figure 6:
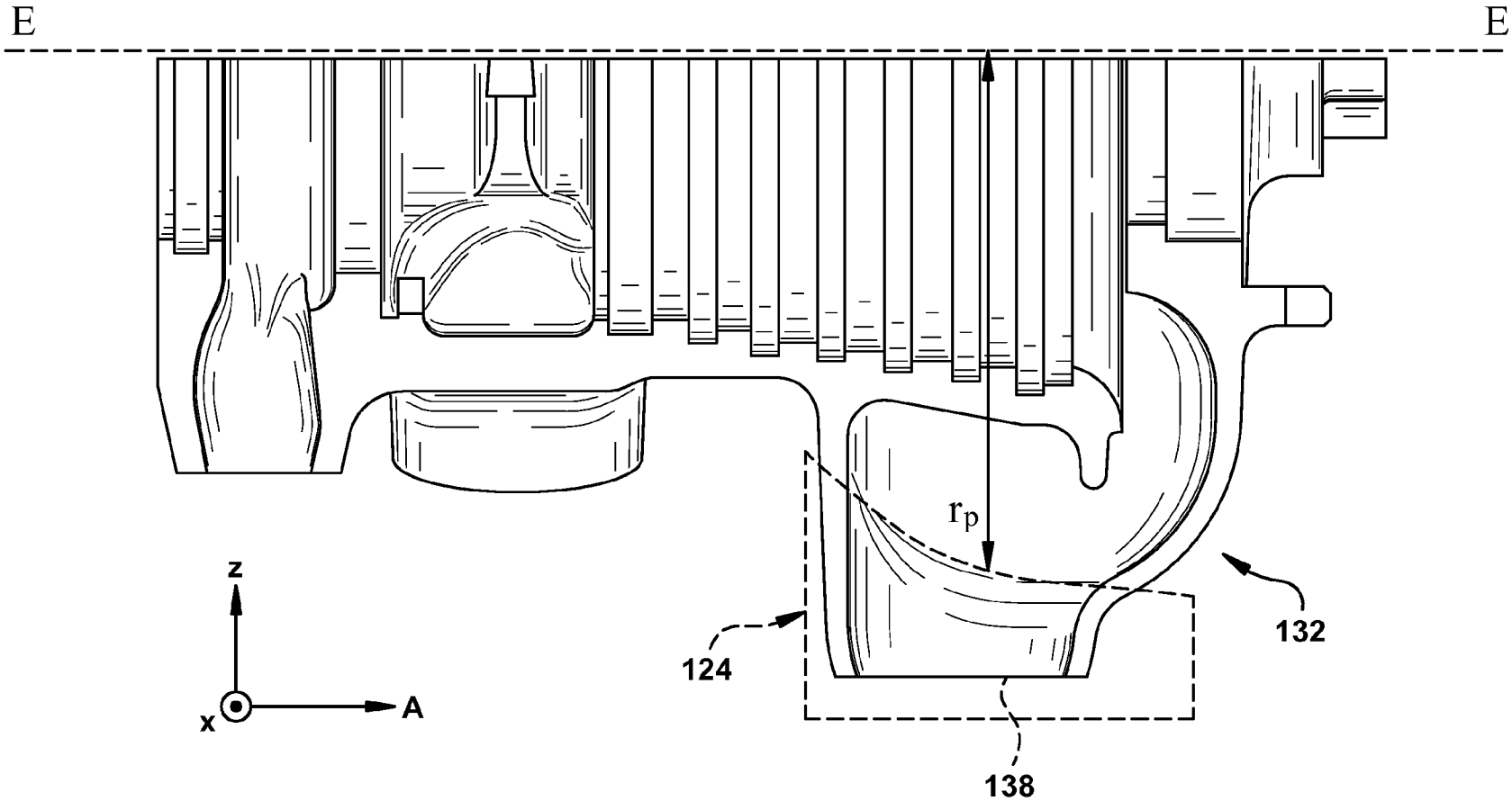
FIG. 6 shows a partial cut-away through an axial vertical center line of an intermediate pressure section of the steam turbine shell of FIG. 4.

Turning to FIG. 6, a partial cut-away view of the second section 132 of a shell portion is shown. This partial cut-away is shown cut along the axis of the rotor 36, showing approximately half of second section 132 below equatorial plane (E). This view illustrates the polar radius (rp) from a perspective inside section 132. Also shown is optional LP admission inlet 124, which may include substantially flattened portion 138.

Figure 7:
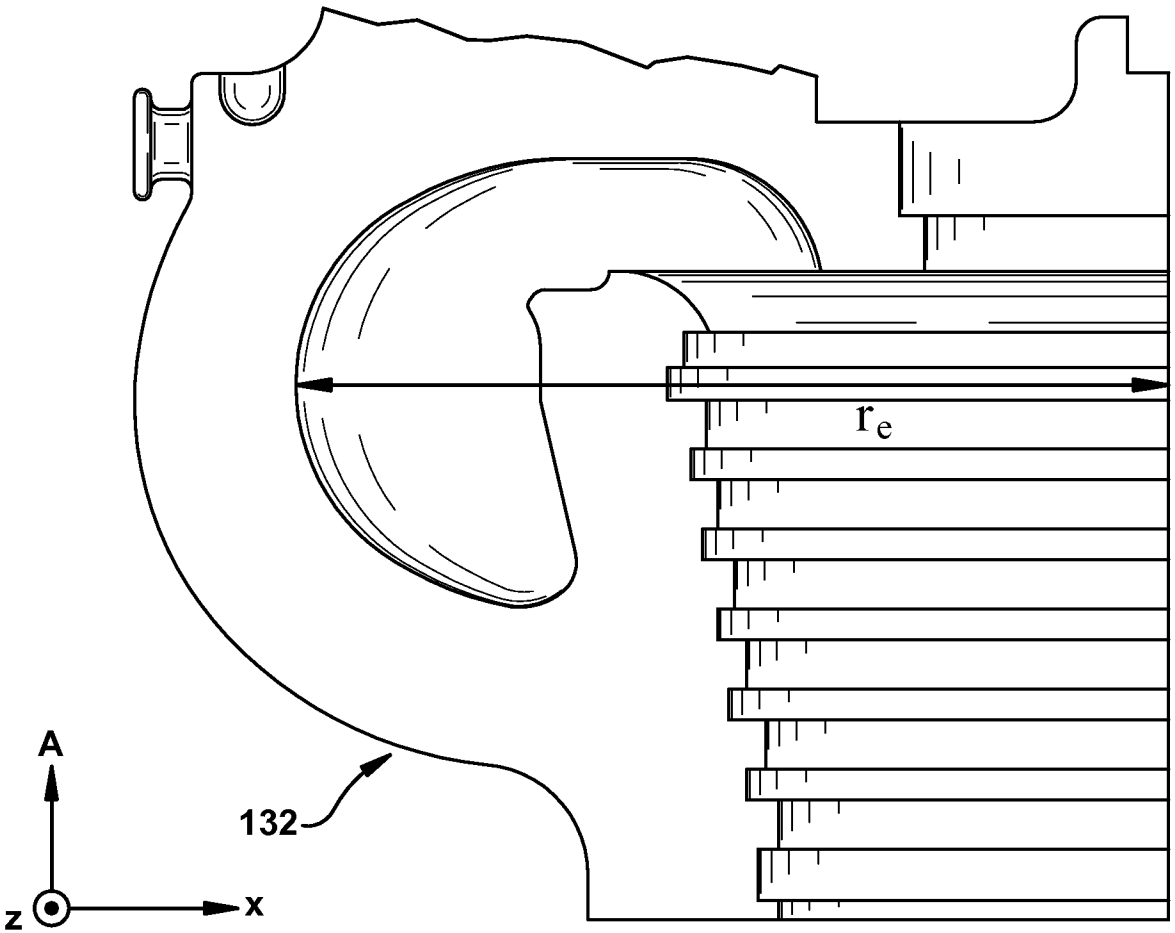
FIG. 7 shows a partial cut-away top view of the intermediate pressure section of the steam turbine shell of FIG. 6.

FIG. 7 shows a partial cut away top view of the second section 132 of FIG. 6. Equatorial radius (re) is shown spanning from an axial center line of a rotor (e.g., rotor 36, not shown) to the outer wall of flow channel (or, path) 140. It is understood, that according to embodiments herein, equatorial radius (re) may be approximately thirty three percent greater than polar radius (rp) (FIG. 6).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine apparatus comprising:
an exhaust shell portion including:
a first section having a semi-circular cross-section;
an exhaust section contiguous with the first section, the exhaust section including an exhaust outlet; and
a second section having an oblate spherical cross-section including a substantially flattened portion, the second section configured to fluidly connect with the first section, wherein the first section and the second section form a continuous steam flow path.

2. The apparatus of claim 1, wherein the first section includes an upper shell section, and wherein the second section includes a lower shell section.

3. The apparatus of claim 2, wherein the upper shell section and the lower shell section collectively form a steam channel, the steam channel having a greater radial depth at an uppermost portion of the lower shell section than at a lowermost portion of the lower shell section.

4. The apparatus of claim 2, wherein the lower shell section is devoid of a nozzle connection.

5. The apparatus of claim 4, wherein the upper shell section includes a low-pressure (LP) admission inlet.

6. The apparatus of claim 1, wherein the substantially flattened portion opposes the exhaust outlet of the first section.

7. The apparatus of claim 1, wherein the exhaust section is tapered at the exhaust outlet.

8. The apparatus of claim 7, wherein the first section is an upper shell section and the second section is a lower shell section, wherein the first section and the second section are configured to join along an axial plane, and wherein the substantially flattened portion of the lower shell section is closer to the axial plane than a bottom portion of the exhaust section.

9. The apparatus of claim 1, further comprising a rotor having an axial center and at least partially surrounded by the first section and the second section, wherein the first section and the second section are configured to join along an axial plane, and wherein portions of an outer surface of the second section located along the axial plane are farther from the axial center than a portion of the outer surface located along a plane perpendicular to the axial plane.

10. The apparatus of claim 1, wherein the second section includes a lower shell casing section including a low-pressure (LP) admission inlet configured to emit approximately zero to approximately five percent of an amount of exhaust steam emitted from the exhaust outlet.

11. The apparatus of claim 1, wherein the second section has a polar radius and a first equatorial radius in an approximate ratio of Z:X, wherein Z=3 and X=4.

12. A steam turbine system comprising:

a rotor;

a plurality of blades operably connected to the rotor; and a shell surrounding the rotor and the blades, the shell including:

an exhaust shell portion including:

a first section having a semi-circular cross-section;

an exhaust section contiguous with the first section, the exhaust section including an exhaust outlet; and a second section having an oblate spherical cross-section including a substantially unitary bottom portion, the second section configured to fluidly connect with the first section, wherein the first section and the second section form a continuous steam flow path.

13. The system of claim 12, wherein the first section is an upper shell section, and wherein the second section is a lower shell section.

14. The system of claim 13, wherein the upper shell section and the lower shell section collectively form a steam channel, the steam channel having a greater radial depth at an uppermost portion of the lower shell section than at a lowermost portion of the lower shell section.

15. The system of claim 12, wherein the exhaust section is tapered at the exhaust outlet.

16. The system of claim 15, wherein the upper shell section and the lower shell section are configured to join along an axial plane, and wherein a bottom portion of the lower shell section is closer to the axial plane than a base portion of the exhaust outlet.

17. The system of claim 12, wherein the rotor has an axial center, the first section and the second section are configured to join along an axial plane, and wherein portions of an outer surface of the second section located along the axial plane are farther from the axial center than a portion of the outer surface located along a plane perpendicular to the axial plane.

18. The system of claim 12, wherein the second section is a lower shell section including a low-pressure (LP) admission inlet configured to emit approximately zero to approximately five percent of an amount of exhaust steam emitted from the intermediate-pressure exhaust outlet.

19. A steam turbine shell portion comprising:

a first section having a semi-circular cross-section;

an exhaust section contiguous with the first section, the exhaust section including an exhaust outlet; and a second section configured to fluidly connect with the first section, the second section having an oblate spherical cross-section including a unitary bottom, the second section having a polar radius, a first equatorial radius, and a second equatorial radius in an approximate ratio of Z:X, wherein Z=3, and X=4.

20. The steam turbine shell portion of claim 19, wherein the second section having the oblate spherical cross-section includes a substantially flattened bottom portion.

* * * * *